US005791513A

United States Patent [19]

Intini

[11] Patent Number: 5,791,513

[45] Date of Patent: Aug. 11, 1998

[54] MEDICATION DISPENSING AID

[76] Inventor: Thomas D. Intini, 9270 Recollet Street, Ville Brossard, Quebec, Canada, J4X 1B9

[21] Appl. No.: 696,225

[22] Filed: Aug. 13, 1996

[51] Int. Cl.[6] ..... G07F 11/72

[52] U.S. Cl. ..... 221/30

[58] Field of Search ..... 221/30, 31, 26, 221/25

[56] References Cited

U.S. PATENT DOCUMENTS 5,368,187 11/1994 Poncetta et al. ..... 221/30

*Primary Examiner*—Kenneth Noland
*Attorney, Agent, or Firm*—Eric Fincham

[57] ABSTRACT

A pill dispensing device for use in dispensing a capsule from a blister pack which comprises first and second hingedly connected members, the second member having a support area and an aperture formed within the support area and having a resilient cushion element mounted within the support area. The first member has a pusher element extending outwardly therefrom, the arrangement being such that when the first and second members are moved in a hinged manner with respect to each other, the pressure element will push the capsule through the blister package to be dispensed thereby making the dispensing relatively easy despite a lack of strength or flexibility on the part of the user.

5 Claims, 2 Drawing Sheets

MEDICATION DISPENSING AID

BACKGROUND OF THE INVENTION

The present invention relates to a medication aid and more particularly, relates to a medication dispensing aid adapted to dispense medication from blister packs.

It is well known that elderly people are the largest consuming group of medication. It is also common practice for this medication to come in the form of capsules and a common method of packaging these pills or capsules comprises blister packs. These blister packs comprise a backing material usually consisting of one or more layers of cardboard/foil combinations and an upper cover layer of plastic with the individual pill or capsule being enclosed thereby in a pocket. For dispensing, one is required to push the pill or tablet through a back rupturable layer. As will be appreciated, many elderly people find such an operation difficult due to their lack of strength and/or flexibility.

SUMMARY OF THE INVENTION

It is an object of the present invention to provide a medication dispensing aid for removing a capsule or tablet from a blister type packaging.

It is a further object of the present invention to provide a dispensing aid for removing a tablet or capsule from a blister pack wherein the aid is convenient to use, readily portable and ergonomically designed.

According to one aspect of the present invention, there is provided a pill dispensing device for use in dispensing a capsule from a blister pack, the device comprising first and second members hingedly secured together. The second member has a support area with an aperture formed within the support area and a resilient cushion element mounted within the support area. The resilient cushion element also has an aperture formed therein which is in registry with the aperture formed in the support area. The first member has a pusher element extending outwardly therefrom, the arrangement being such that when the first and second members are hingedly moved together with respect to each other, the pusher element is in registry with the aperture.

The dispensing aid may be formed of any number of suitable materials known to those skilled in the art with a particularly preferred material being a plastic material. The structural parts may be injection molded while the resilient cushion element may conveniently be an extruded die cut foam product.

Having thus generally described the invention, reference will be made to the accompanying drawings illustrating an embodiment thereof, in which:

DETAILED DESCRIPTION OF THE INVENTION

Figure 1:
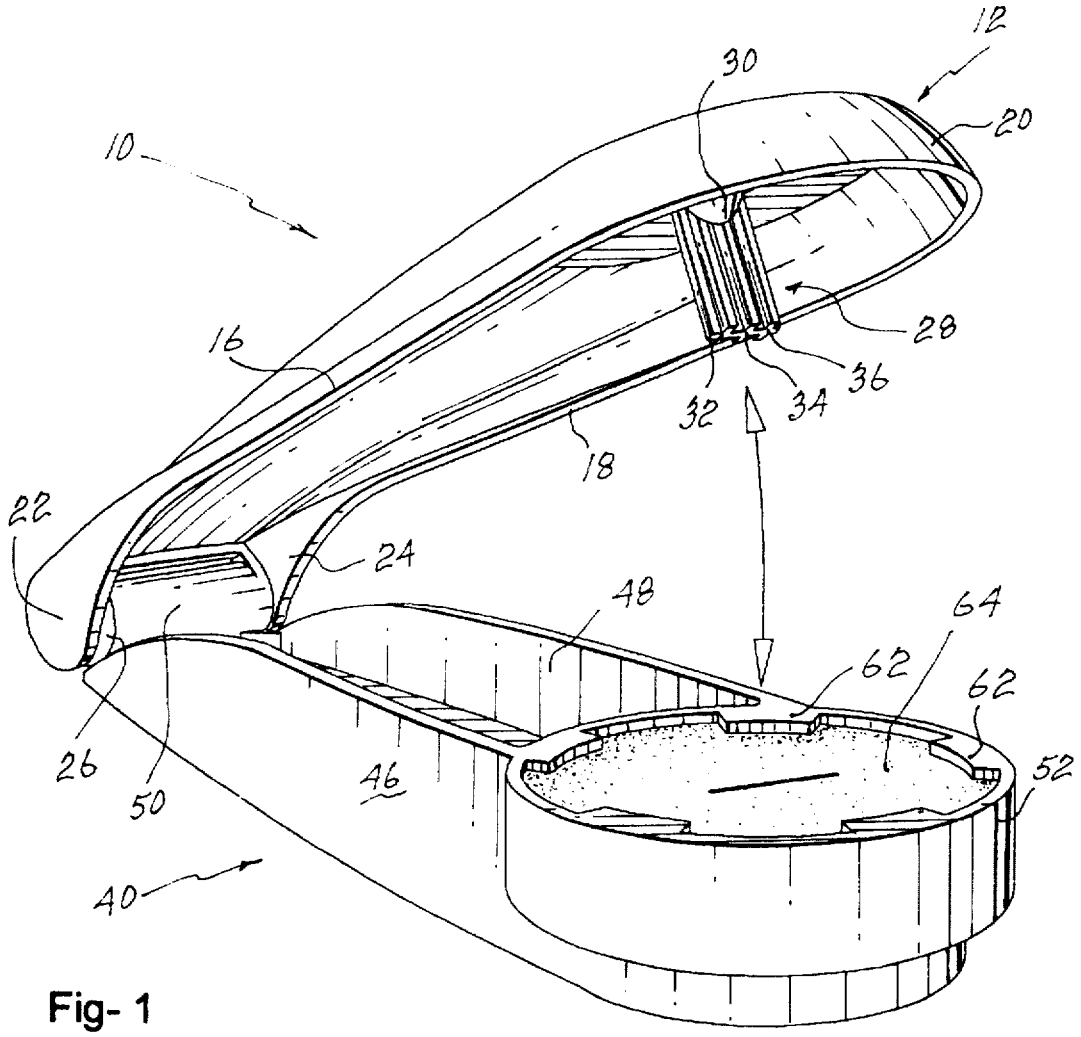
FIG. 1 is a perspective view of a dispensing aid device according to the present invention.

Referring to the drawings in greater detail and by reference characters thereto, the capsule dispensing device is designated generally by reference numeral 10 and includes an upper member 12 and a lower member 40.

Figure 3:
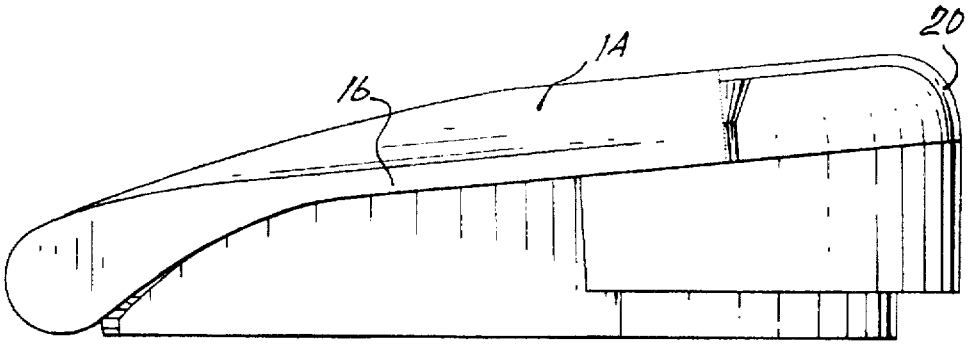
FIG. 3 is a side elevational view thereof.

Upper member 12 is defined by an upper or top wall 14 of a somewhat arcuate configuration and which terminates in a pair of side walls 16 and 18. A front wall 20 is also of an arcuate configuration and merges arcuately with side wall 16 and 18 and upper wall 14. As may be best seen in FIG. 3, front wall 20 is transparent in nature as is a portion of upper wall 14 adjacent thereto. At the end of side walls 16 and 18 which are opposed to front wall 20, there is provided a pair of rearwardly extending ears 22 and 24 from side wall 16 and 18 respectively. A shaft 26 extends between ears 22 and 24.

A pusher element 28 extends from an inwardly facing surface of upper wall 14. Pusher element 28 has a frustoconically shaped base portion 30 merging with upper wall 14 and which terminates in three cruciform shaped elements 32, 34 and 36 which are molded as a single component. Cruciform shaped elements 32, 34 and 36 have flat outer surface.

Figure 2:
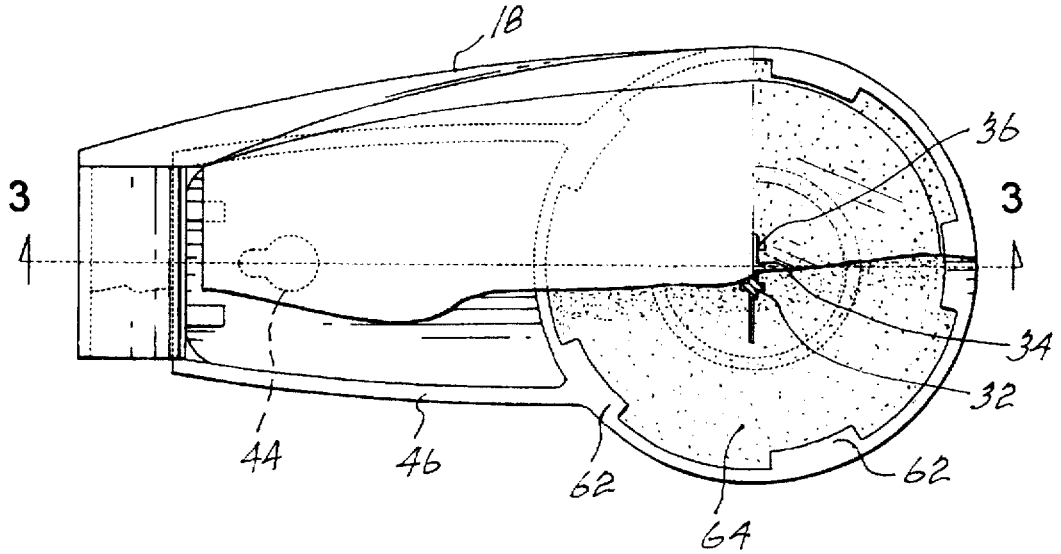
FIG. 2 is a top view, partially in cutaway, of the dispensing aid device of FIG. 1.

Lower member 40 has a base wall 42 adjacent one end thereof with a key shaped aperture 44 (shown in dotted lines in FIG. 2) formed therein. A pair of side walls 46 and 48 extend upwardly from bottom wall 42. A "D" hinge 50 is adapted to receive shaft 26 in a known manner for hinged movement of upper member 12 and lower member 40 with respect to each other.

At the other end of bottom member 40, there is provided an outer annular wall 52 which merges with side walls 46 and 48. As may be best seen in FIG. 1, outer annular wall 52 does not extend the full depth to the horizontal plane of bottom wall 42. Located inwardly of outer annular wall 52 is inner annular wall 54; inner annular wall 54 terminates, at its lower end, in a plane substantially the same as the plane of bottom wall 42. However, inner annular wall 54 does not extend upwardly to the same height as outer annular wall 52.

Extending inwardly from outer annular wall 52 and continuing past the upper peripheral edge of inner annular wall 54 is a base wall 56. Base wall 56 terminates in a downwardly extending annular flange 58 which defines an aperture 60 therebetween.

Extending radially inwardly from the upper free marginal edge of outer annular wall 52 are a plurality of inwardly extending retaining flange segments 62. A support element 64 formed of a suitable resilient material such as a foam material is adapted to seat on support base 56 and be retained in position by inwardly extending retaining flange segments 62 as may best be seen in FIGS. 4 and 5. Support element 64 includes a slit 66 formed therein for reasons which will become apparent hereinbelow.

Figure 4:
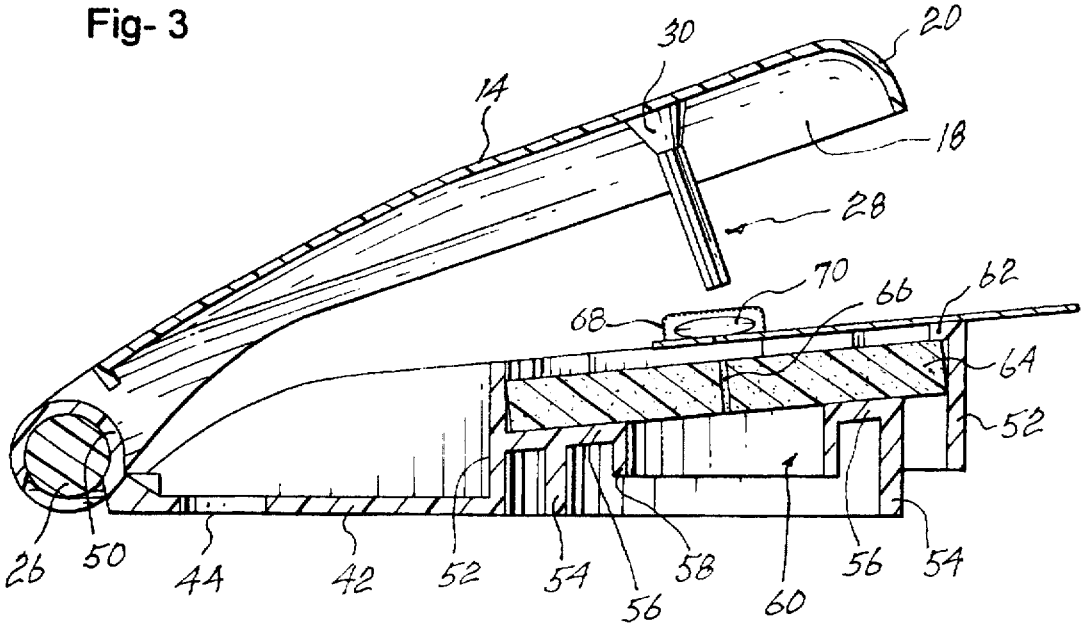
FIG. 4 is a sectional view taken along the lines 3—3 of FIG. 2.
Figure 5:
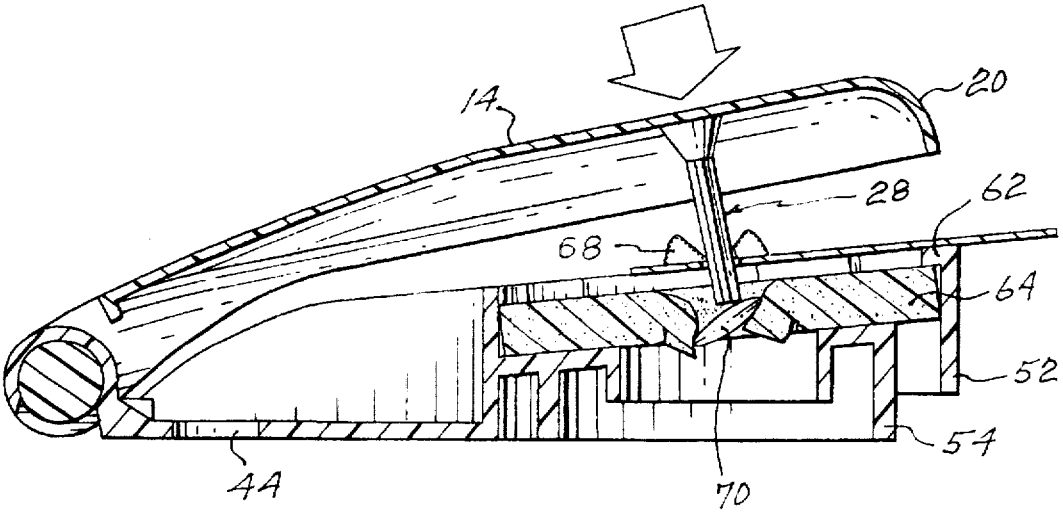
FIG. 5 is a view similar to FIG. 4 illustrating operation of the capsule dispensing device.

In operation, and as seen in FIGS. 4 and 5, a blister pack 62 containing a capsule 64 is placed in position whereby the capsule 64 is in general alignment with slit 66 of support element 64. Upper member 12 is then moved by means of its hinge connection such that pusher element 28 will contact blister 62 and force capsule 66 through the rupturable portion of the package and it is then dispensed through slits 66 and aperture 60.

It will be understood that the above described embodiment is for purposes of illustration only and that changes and modifications may be made thereto without departing from the spirit and scope of the invention.

I claim:

1. A pill dispensing device for use in dispensing a capsule from a blister pack, the device comprising a first member and a second member, said first member and said second member being hingedly secured together, said second member having a support area and an aperture formed within said support area, a resilient cushion element mounted within said support area, an aperture being formed within said resilient support element and in registry with said aperture formed in said support area, said first member having a pusher element extending outwardly therefrom, the arrangement being such that when said first and second members are moved in a hinged manner in respect to each other, said pusher element is in registry with said apertures.

2. The device of claim 1 wherein said first member and said second member are formed of a plastic material.

3. The device of claim 1 wherein said resilient cushion element comprises a resilient foam material.

4. The dispensing device of claim 3 wherein said aperture formed within said resilient support element comprises a die cut slot formed therein.

5. The device of claim 1 further including a plurality of retaining flanges formed on said second member to retain said resilient cushion element on said support area.

* * * * *